United States Patent [19]

Leliaert

[11] 4,016,681

[45] Apr. 12, 1977

[54] SURFACE TREATMENT DEVICE FOR LARGE DIAMETER PIPE SECTIONS

[75] Inventor: Raymond M. Leliaert, South Bend, Ind.

[73] Assignee: Wheelabrator-Frye, Inc., Mishawaka, Ind.

[22] Filed: Dec. 11, 1975

[21] Appl. No.: 639,909

[52] U.S. Cl. ..... 51/9 M; 51/9 H; 51/15 H

[51] Int. Cl.[2] ..... B24C 3/14; B24C 3/16

[58] Field of Search ..... 51/9, 9 M, 9 HI, 8 HI, 51/15 R, 15 HI

[56] References Cited

UNITED STATES PATENTS

| | | | |
|---|---|---|---|
| 3,034,262 | 5/1962 | Pawlson | 51/9 M |
| 3,052,245 | 9/1962 | Nagle | 51/15 X |
| 3,151,418 | 10/1964 | Powell | 51/9 HI |
| 3,750,339 | 8/1973 | Barnes | 51/9 HI |
| 3,824,738 | 7/1974 | Hall | 51/9 HI |
| 3,835,587 | 9/1974 | Hall | 51/9 HI |

*Primary Examiner*—Gary L. Smith
*Attorney, Agent, or Firm*—McDougall, Hersh & Scott

[57] ABSTRACT

A surface treatment device is disclosed which is capable of effecting surface treatment of the inside and outside of large diameter pipe sections. The device preferably employs an airless centrifugal blast wheel mounted on a support arm which is extensible into and out of the interior of the pipe section or, alternatively, along the exterior of the pipe section. The support arm contains the necessary power cables and ducts to connect the blast head to a dust collector and control panel. The pipe section is rotated on a motorized roller bed.

8 Claims, 5 Drawing Figures

SURFACE TREATMENT DEVICE FOR LARGE DIAMETER PIPE SECTIONS

BACKGROUND OF THE INVENTION

This invention relates to the field of surface treatment apparatus. More specifically, it relates to devices capable of surface treatment of large diameter pipes, tubing, and like cylindrical objects. By surface treatment it is meant to describe such techniques as blast cleaning, peening, abrading, etc. Such treatments are usually accomplished by projecting abrasive particulate, such as steel shot, grit, sand and like abrasives against the surface to be treated with the necessary velocity and exposure time to accomplish the desired treatment effect. The abrasive may be projected against the surface by means of air pressure blasting or by airless means as, for example, by use of a centrifugal blasting wheel of the type manufactured by Wheelabrator-Frye Incorporated of Mishawaka, Ind.

Surface treatment devices are known in the art as, for example, the device disclosed in U.S. Pat. No. 3,900,969 to Diehn assigned to the present assignee. That patent, which is incorporated herein by reference, discloses a portable blast cleaning apparatus capable of treating generally vertical surfaces. Such a device, with necessary modifications, can be utilized in the present invention as the blasting head.

It is an object of the present invention to provide a device capable of cleaning the inside and outside of large diameter pipe sections.

It is another object of the invention to provide a device capable of surface treatment of large diameter pipe sections.

These and other objects and advantages of the invention will become apparent from the concluding portion of the specification.

DETAILED DESCRIPTION

Figure 1:
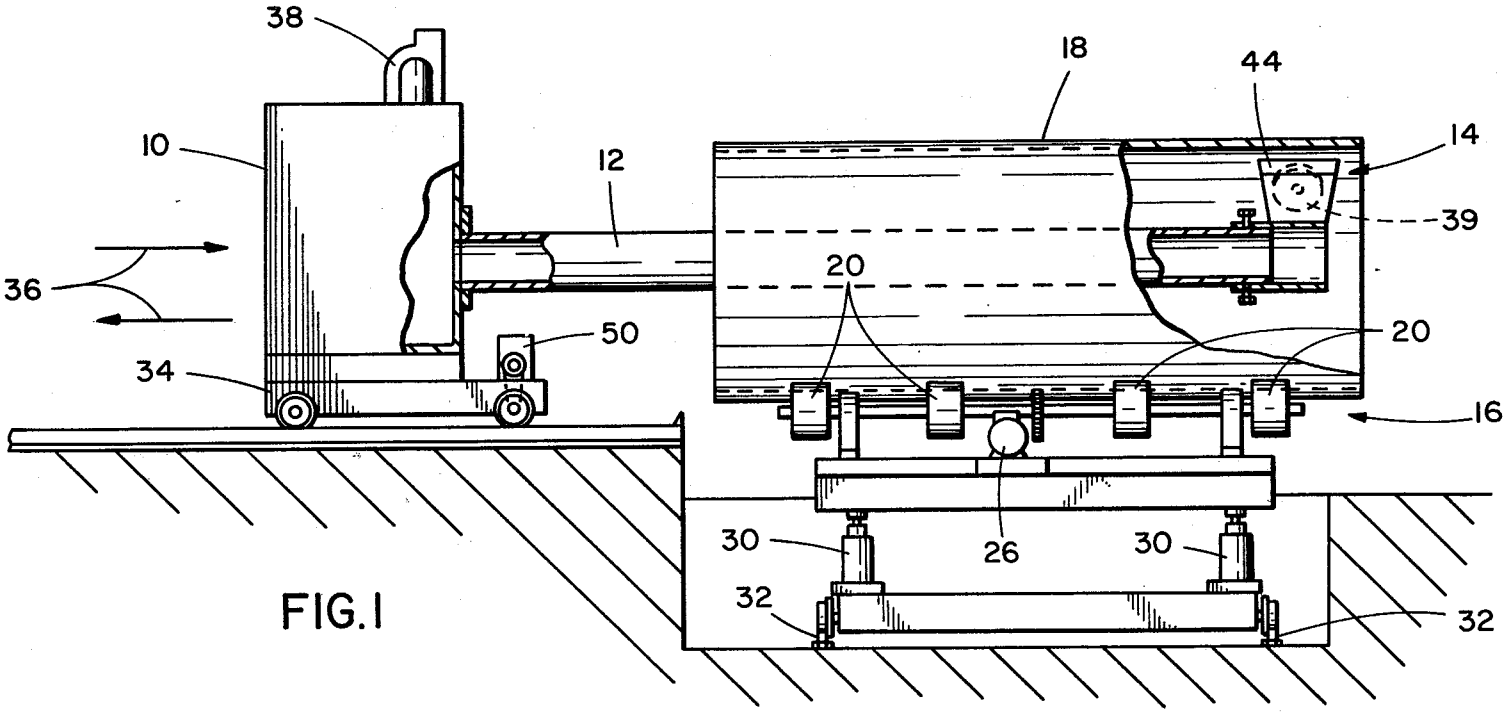
FIG. 1 is a side elevation of the device according to the present invention in which the blast cleaning head is inserted into the interior of a large diameter pipe section.

Referring to the drawings, the surface treatment device according to the present invention is illustrated. The device consists of a control panel and dust collector 10, a blast head support arm 12, a blasting device 14 attached to the far end of the support arm 12, and a motorized support table indicated generally at 16. It will be seen that a large diameter pipe section, such as section 18, is supported on the table 16 by means of a plurality of rollers 20 and 22. Rollers 20 are provided on a common shaft 24 which shaft is driven by motor 26 for the purpose of rotating rollers 20 which, in turn, cause pipe section 18 to rotate about a horizontal axis. By controlling the speed of motor 26, the rate of rotation of pipe 18 can be maintained as desired. The selected rate, as will be appreciated, will depend upon the type of surface treatment operation desired. The rollers 22 are similarly mounted on a common shaft 25 but need not be driven.

Figure 4:
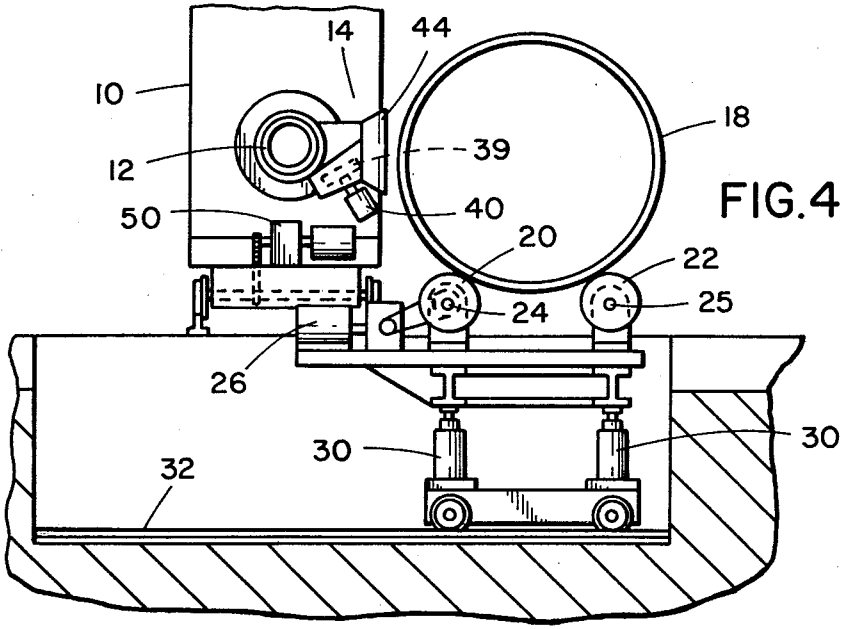
FIG. 4 is an end elevation similar to FIG. 3 in which the blast head is positioned to clean the outside surface of the pipe section.
Figure 3:
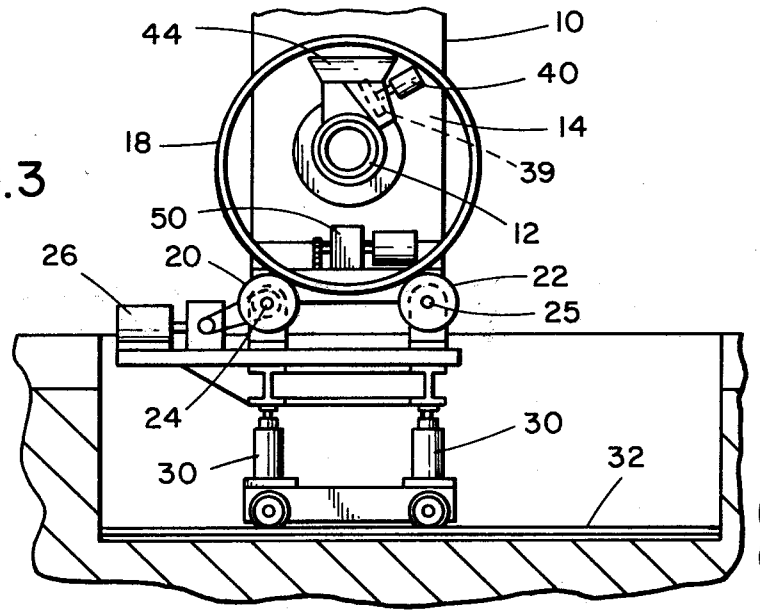
FIG. 3 is an end elevation of the system according to FIG. 1 illustrating the manner in which the pipe section is rotated.

The rollers, shafts and motor assembly are provided on a support bed 30 illustrated in FIGS. 3 and 4 which is laterally movable on a track 32 to position the pipe section 18 with respect to the control panel 10 and the support arm 12. By changing the lateral position of bed 30 the pipe section can be located so that the blast head 14 can be extended into the pipe or positioned near the pipe exterior to effect either internal or external surface treatment.

Returning to FIG. 1, the control panel and dust collector 10 is mounted on a cart 34 for movement in the directions indicated by arrows 36; that is, the control panel and support arm 12 connected thereto are extensible into and retractable out of the pipe section 18. The dust collector incorporates a blower fan 38 and dust collector of known construction.

The support arm 12 is connected to the control panel 10 and preferably has a hollow interior to provide room for the necessary electric power lines to the blast head 14 from the control panel as well as the air duct from the blast head to the dust collector.

Referring to the blast head 14, it will be appreciated that many blast heads which are commercially available can be adapted for use with the present invention. Thus, an air pressure blasting device could be installed at the end of support arm 12. Preferably, however, an airless centrifugal blasting wheel is utilized and in particular a blasting device such as disclosed in the aforementioned U.S. Pat. No. 3,900,969. That device has an airless centrifugal blast wheel 39 driven by a motor 40 to project a supply of abrasive contained therein against the surface being treated. The abrasive is thrown with sufficient kinetic energy to rebound from the treatment surface back into a collection corridor from which it is recycled for subsequent surface treatment.

A compliant seal 44 is provided at the opening to the blast head for enclosing the treatment area to assure a substantially complete recovery of the abrasive. Desirably an air stream is passed through the device to remove dust and fine particulate matter. This air stream is conducted to the dust collector 10 via a conduit which may be part of or placed in support arm 12.

Operation

Figure 2:
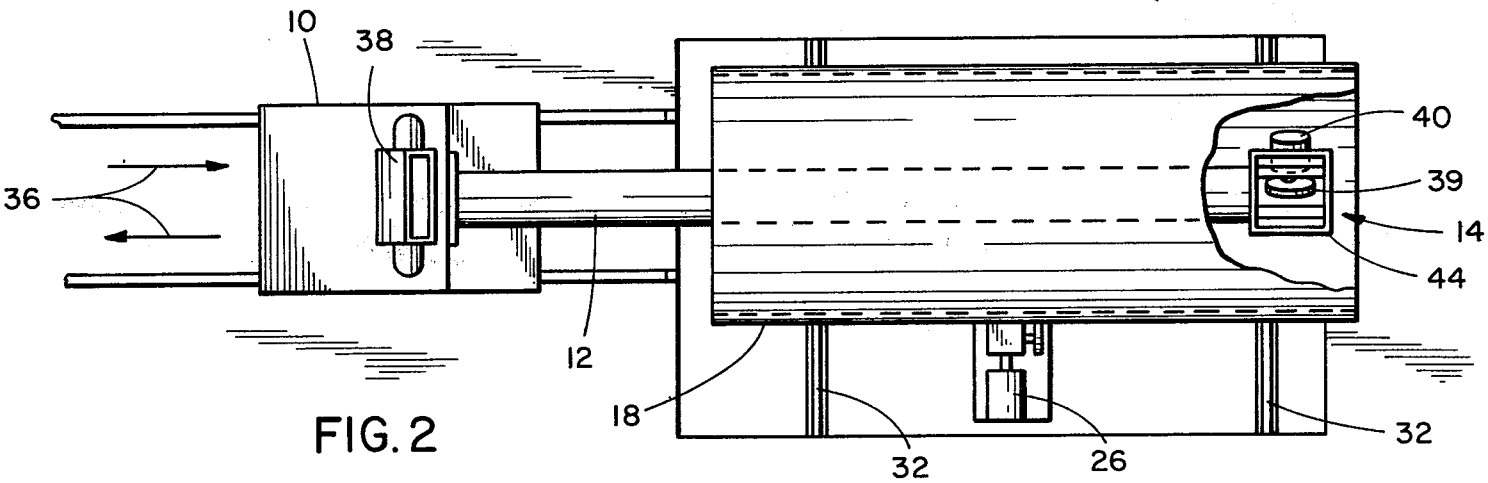
FIG. 2 is a plan view of the apparatus of FIG. 1.

Considering the operation of the device and with particular reference to FIGS. 1–3, when it is desired to treat the inside diameter of pipe 18 the cart 30 is positioned in alignment with the control panel 10 and support arm 12 (FIG. 3). The support arm 12 is then extended into the interior of the pipe and motor 26 is energized to initiate rotation of pipe section 18. The treatment device 14 is then turned on.

As the treatment device completes treatment of a given segment of pipe section 18, the support arm 12 moves the device 14 to a new segment of the pipe as, for example, by means of motor 50 to drive cart 34. This process continues until the entire internal surface of the pipe has been treated. Dust and debris generated by the surface treatment are removed from the blast head by an air stream through the support arm 12 and collected in the dust collector.

Figure 5:
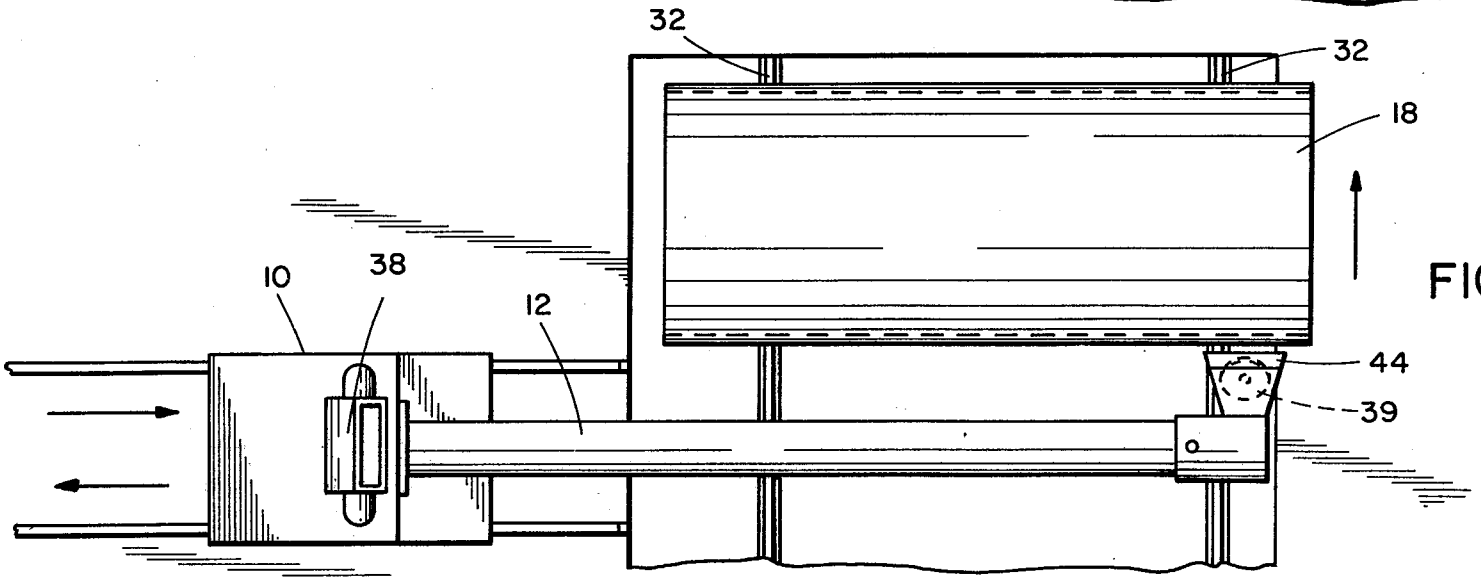
FIG. 5 is a plan view of the arrangement illustrated in FIG. 4.

With reference to FIGS. 4 and 5, the alternate operation of the device is illustrated. In this situation the exterior surface is being treated due to the fact that cart 30 is positioned to the right of the support arm 12.

While the disclosure thus far illustrates only a single support arm and blast head and indicates that the interior and exterior can alternatively be cleaned, it is, of course, possible to provide a pair of support arms and blast heads so that the inside and outside surface of a pipe section can be cleaned simultaneously. The second arm and blast head preferably will be identical to the blast head and support arm illustrated in the drawings.

While I have shown and described embodiments of this invention in some detail, it will be understood that this description and illustrations are offered merely by way of example and that the invention is to be limited in scope only by the appended claims.

I claim:

1. A device for surface treatment of the inside and outside of large diameter cylinders comprising:

a. projecting means including a centrifugal blast wheel for projecting particulate against the surface of said cylinder as it rotates, means integral with said projecting means for recovering the projected particulate and a compliant seal disposed about the opening to said projecting means to confine the particulate to the projecting means, b. means for supporting said cylinder including i. means for rotating said cylinder about a horizontal axis, ii. means for moving said cylinder between a first position where said wheel will treat the outside of said cylinder and a second position where said wheel will treat the inside of said cylinder, c. means mounting said projecting means for movement into and out of proximity with the surface of said cylinder to be treated.

2. The device according to claim 1 wherein said lateral positioning means include a wheeled support bed and tracks along which said support bed may be moved to achieve a desired position.

3. The device according to claim 1 wherein said support means includes two sets of roller supports secured beneath said cylinder and spaced to maintain said cylinder supported thereon.

4. The device according to claim 3 wherein one set of roller supports are mounted to a common shaft and further including means for driving said shaft to rotate said one set of rollers and ultimately said cylinder.

5. The device according to claim 1 wherein said means for rotating said cylinder include at least one set of roller supports secured to a common shaft, means for driving said shaft to rotate said roller supports and said cylinder supported thereon.

6. The device according to claim 1 wherein said device further includes means for removing dust from said projecting means.

7. The device according to claim 1 wherein said mounting means includes a horizontally disposed support arm to which said projecting means is mounted at one end thereof and means for positioning said one end of said support arm.

8. The device according to claim 7 wherein said positioning means includes a wheeled cart, said support arm having its other end mounted to said cart.

* * * * *